United States Patent [19]

Kochevar et al.

[11] Patent Number: 4,736,667

[45] Date of Patent: Apr. 12, 1988

[54] SPEED-LOADING DEVICE FOR CARTRIDGES

[76] Inventors: Rudolph J. Kochevar, 252 Arbolada Dr., Arcadia, Calif. 91006; Donald M. Kelly, 35 S. Sunnyside Ave., Sierra Madre, Calif. 91024

[21] Appl. No.: 848,253

[22] Filed: Apr. 4, 1986

[51] Int. Cl.[4] ..... F42B 3/00; F42B 5/26; F41C 25/00

[52] U.S. Cl. ..... 86/44; 42/87; 86/23; 86/45; 86/46; 206/3; 221/156; 221/171; 221/306

[58] Field of Search ..... 86/23–24, 86/44–48; 206/3; 89/33.1, 34; 42/87, 88, 50; 198/376, 399; 221/156, 171, 303, 304, 306; 414/762, 765, 786, 787; 10/162 A

[56] References Cited

U.S. PATENT DOCUMENTS

| | | | |
|---|---|---|---|
| 1,178,785 | 4/1916 | Debuchy | 42/87 |
| 2,326,816 | 8/1943 | Woodberry | 86/45 |
| 2,356,806 | 8/1944 | Woodberry et al. | 86/45 |
| 2,394,033 | 2/1946 | Wossum | 86/47 |
| 2,402,195 | 6/1946 | Woodberry et al. | 86/45 |
| 2,406,176 | 8/1946 | Vergobbi | 86/45 |
| 2,451,521 | 10/1948 | Uglum | 86/47 |
| 2,453,736 | 11/1948 | Woodberry et al. | 86/45 |
| 2,819,575 | 1/1958 | Ervine | 86/47 |
| 2,848,855 | 8/1958 | Ervine et al. | 86/47 |
| 2,981,024 | 4/1961 | Skoff | 42/87 |
| 3,628,273 | 12/1971 | Lach | 42/87 |
| 4,158,321 | 6/1979 | Meacham | 86/45 |
| 4,261,680 | 4/1981 | Carnley et al. | 86/45 |
| 4,392,321 | 7/1983 | Bosworth | 42/87 |
| 4,455,915 | 6/1984 | Ransom | 86/45 |

*Primary Examiner*—Stephen J. Lechert, Jr.
*Assistant Examiner*—Howard J. Locker
*Attorney, Agent, or Firm*—Gordon L. Peterson

[57] ABSTRACT

A speed-loading device comprising a container having an interior chamber and a discharge opening leading from the chamber to the exterior of the container. The container has a storage section in the chamber for storing cartridges in side-by-side relationship and an orienting section in the chamber between the opening and the storage section. The container can be oriented so that the cartridges in the chamber can fall by gravity from the storage section through the orienting section and out through the discharge opening. A removable blocking member blocks the flow of cartridges out through the discharge opening. The orienting section rotates the cartridges as they fall through the orienting section toward the discharge opening so that the cartridges fall end first through the discharge opening.

18 Claims, 2 Drawing Sheets

Fig. 3
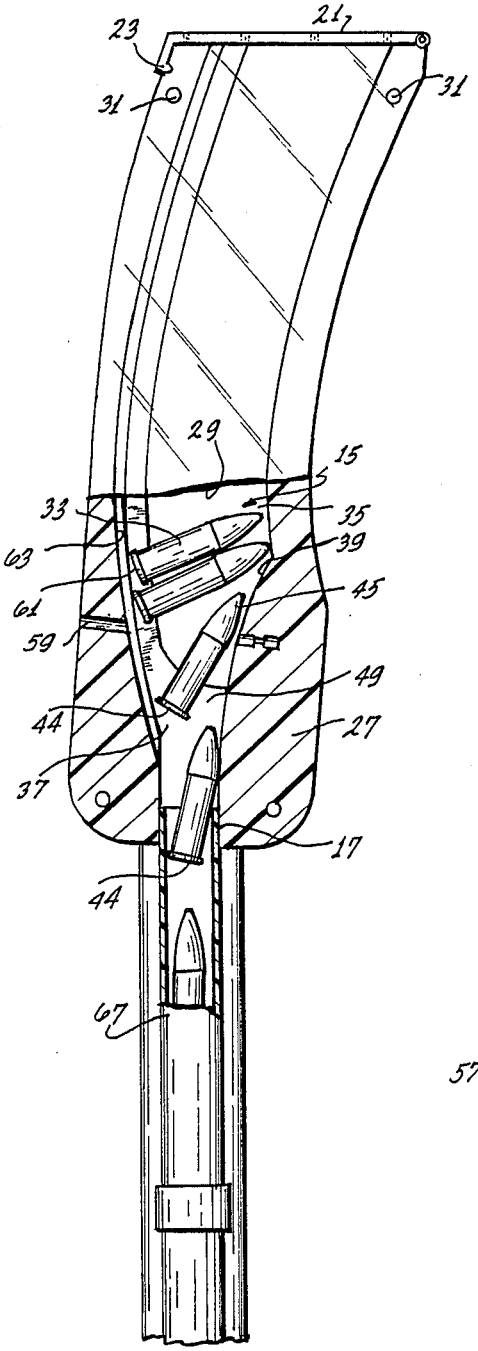
Fig. 6
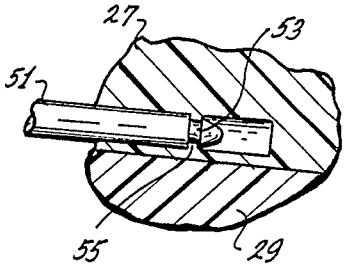
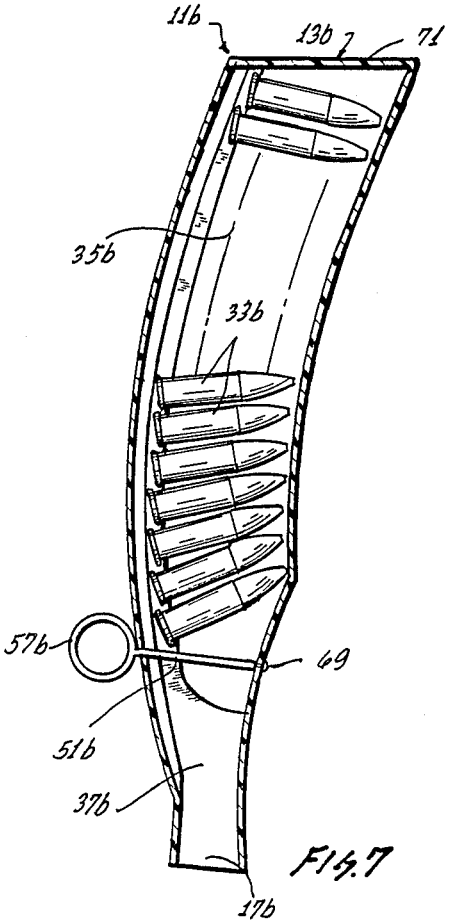
Fig. 7

SPEED-LOADING DEVICE FOR CARTRIDGES

BACKGROUND OF THE INVENTION

Small bore rifles, such as 22 caliber rifles, commonly have an elongated tubular magazine into which cartridges can be loaded. Loading is typically accomplished manually by dropping single cartridges into the upper end of the magazine. This manual loading operation is quite time consuming.

In an effort to speed up this manual loading operation, cartridges can be preloaded in end-to-end or in-line fashion into storage tubes. Storage tubes of this type are discussed, for example, in Hoagland U.S. Pat. No. 1,085,125 and Paulson U.S. Pat. No. 1,340,737. Cartridges from the storage tube can be, in effect, poured into the tubular magazine.

One problem with storage tubes of this type is that they must be quite long in order to hold any significant number of cartridges. This makes them inconvenient to manually transport and use in the field.

SUMMARY OF THE INVENTION

This invention provides a speed-loading device for cartridges which takes much less room than the storage tubes discussed above and which can be easily carried in the user's pocket. With this invention, substantial space savings and size reduction are accomplished by storing the cartridges in side-by-side relationship in one or more rows. Accordingly, the speed-loading device can be much shorter than the storage tubes of the prior art.

In order to be suitable for use with a tubular magazine, the cartridges must be dispensed by the speed-loading device in end-to-end relationship. Accordingly, this invention provides novel orienting means for rotating the cartridges from the side-by-side relationship in which they are stored to an end-to-end relationship when they are dispensed. This is accomplished automatically as the cartridges fall by gravity through the speed-loading device.

Normally, the flow of cartridges from the loading device is blocked. However, the cartridge flow can be manually unblocked when desired to allow the cartridges to fall by gravity and be properly oriented when they are dispensed into the tubular magazine.

The features of this invention can be embodied in a speed-loading device which includes a container having an interior chamber and a discharge opening leading from the chamber to the exterior of the container. The container has a storage section in the chamber for storing a plurality of cartridges in side-by-side relationship within the chamber and an orienting section in the chamber. The container is orientable so that the cartridges in the chamber can fall by gravity from the storage section through the orienting section and out through the discharge opening.

The loading device also has means for blocking the flow of cartridges from the chamber out through the discharge opening. The blocking means is openable or operable to allow all of the cartridges in the chamber to rapidly fall by gravity from the storage section through the orienting section and out through the discharge opening. For example, the blocking means may include a removable blocking member extending at least part way across the chamber at the desired location and means for releasably retaining the blocking member at least part way across the chamber. At least the lowermost cartridge in the storage section is supported on said blocking member when the speed-loading device is oriented with the discharge opening facing downwardly.

The orienting section includes orienting means for rotating the cartridges as they fall through the orienting section toward the discharge opening so that the cartridges can fall end first through the discharge opening. The orienting means can advantageously include a restriction in the orienting section which extends substantially to the juncture of the storage section and the orienting section, and as a result, the chamber narrows in the orienting section. Such restriction may include a shoulder for engaging an end of the cartridges to assist in pivoting the cartridges as they fall through the orienting section. To reduce the likelihood of a cartridge hanging up on the shoulder, the shoulder is preferably convexly curved.

The cartridges are preferably guided into the orienting section in a predetermined orientation by guide means. Accordingly, the orienting means needs only to pivot or rotate the cartridge from a known or predetermined orientation so that they can pass end first through the discharge opening. The guide means may include, for example, all of the surfaces of the storage section which are adapted to engage the cartridges as the cartridges fall through the storage section toward the orienting section. In addition, to further help maintain the cartridges in the desired side-by-side relationship, the guide means may include a groove or rib extending longitudinally through a length of the storage section for cooperation with a region of the base of the cartridges. The groove or rib forms, in effect, a track for guiding movement of the cartridges toward the orienting section and for introducing the cartridges to the orienting section in the desired predetermined orientation. The track can also space the base of the cartridges from the confronting wall of the chamber to reduce friction and the likelihood of a cartridge hanging up in the storage section.

The speed-loading device may be reusable, in which event, it preferably has a loading opening leading to the storage section and means for releasably closing the loading opening. Alternatively, the speed-loading device may be disposable, in which event, there is no need for a loading opening or a releasable closure for such opening. If the speed-loading device is disposable, it may be constructed of thin plastic material.

The invention, together with additional features and advantages thereof, may best be understood by reference to the following description taken in connection with the accompanying illustrative drawing.

BRIEF DESCRIPTION OF THE DRAWING

FIG. 3 is a side elevational view partially in section of the speed-loading device being used to load a rifle having a tubular magazine.

FIG. 6 is an enlarged fragmentary sectional view illustrating one way of releasably retaining the blocking member in position.

FIG. 7 is a longitudinal sectional view through a second embodiment of the speed-loading device.

DESCRIPTION OF THE PREFERRED EMBODIMENTS

Figure 2:
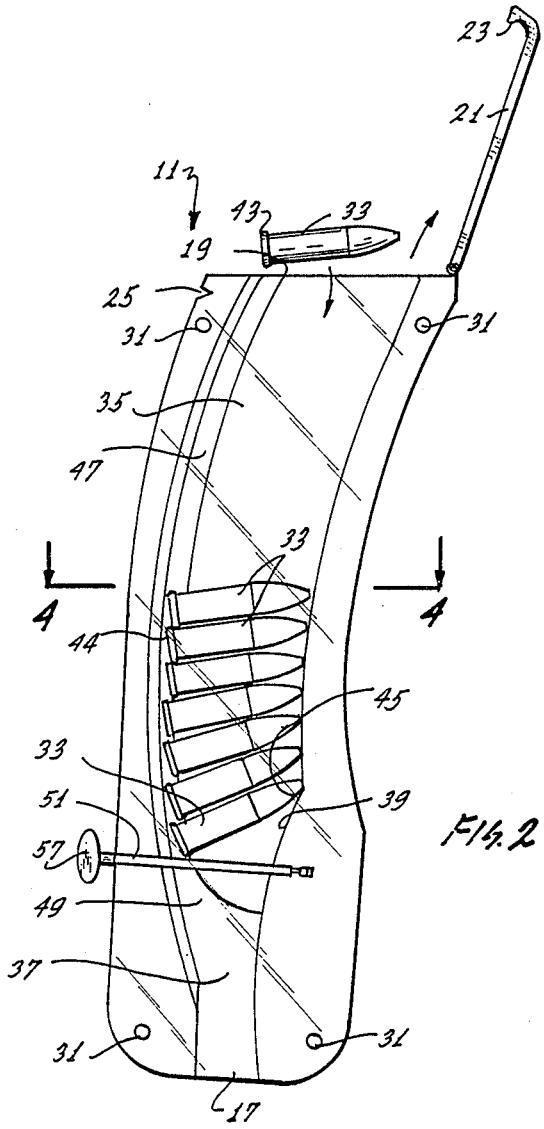
FIG. 2 is a side elevational view of one form of speed-loading device of this invention showing cartridges being loaded into it.
Figure 4:
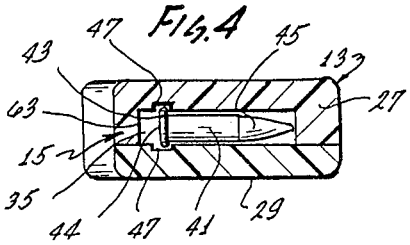
FIG. 4 is a sectional view taken generally along line 4—4 of FIG. 2.

FIGS. 2–4 show a speed-loading device 11 which includes a container 13 having an elongated interior chamber 15 (FIG. 3) and a discharge opening 17 leading from the bottom of the chamber to the exterior of the container. A loading opening 19 is provided at the top of the container 13 and leads to the top of the chamber. The loading opening 19 can be closed by a cover 21 which is pivotally mounted to the upper end of the container 13. The cover 21 can be releasably retained over the loading opening 19 in any suitable manner, such as by a catch 23, receivable in a groove 25 of the container 13.

Although the container 13 can be constructed in different ways, in this embodiment, it comprises a hollow body section 27 (FIG. 4) and a body section 29 suitably joined together by fasteners 31, such as rivets or screws. The body sections 27 and 29 are preferably transparent so that the user can readily determine whether or not cartridges 33 are in the chamber 15.

The chamber 15 has an upper storage section 35 and a lower orienting section 37. The chamber 15 is curved as viewed in side elevation, and a convex shoulder 39 begins at the juncture of the storage section 35 and the orienting section and extends inwardly to form a restriction which narrows the orienting section.

The storage section 35 is adapted to receive many of the cartridges 33 in side-by-side relationship. Although the cartridges 33 could be provided in multiple offset rows, in the illustrated embodiment, the speed-loading device 11 accommodates only a single row of cartridges 33. Each of the cartridges is, of course, conventional and includes a casing 41 having an annular rim 43 at a base 44 of the cartridge and a nose or slug 45 partly received within the casing and defining the other end of the cartridge.

The chamber 15 is sized to loosely accommodate the cartridges 33 so that the cartridges can easily fall by gravity through the chamber. The speed-loading device 11 also includes guide means for guiding the cartridges 33 into the orienting section 37 in a predetermined orientation. In the illustrated embodiment, such guide means include opposed grooves 47 opening into the chamber 15. The grooves 47 extend longitudinally through the storage section 35 and terminate in a relatively wide mouth 49 in the orienting section 37 somewhat below the upper end of the shoulder 39. If desired, the grooves 47 may terminate at the blocking member 51 rather than widening to the mouth 49.

More specifically, the grooves 47 preferably extend at least to a blocking member 51 which extends across the chamber 15 and is releasably retained on the container 13 in any suitable manner, such as by a detent (FIG. 6) which may comprise, for example, an annular groove 53 on an inner end portion of the blocking member and a cooperating rib 55 formed integrally with the body section 27. Although the blocking member 51 can be of different constructions, in the embodiment illustrated, it includes a generally cylindrical pin having an enlarged tab 57 at its outer end. The blocking member 51 is received within a correspondingly shaped bore 59 (FIG. 3) of the body section 27.

The chamber 15 and the grooves 47 are curved as viewed in side elevation in FIGS. 2 and 3. The grooves 47 guide the rims 43 of the cartridges 33 and hold the base 44 of the cartridges in spaced relationship to the confronting wall 63 of the chamber 15.

The speed-loading device 11 may be loaded by the user or sold pre-loaded with the cartridges 33. In any event, loading can be accomplished as shown in FIG. 2 by depositing cartridges 33 manually, or by a loading machine (not shown), through the loading opening 19 to the storage section 35 of the chamber 15, with the rim 43 in the grooves 47. The first cartridge 33 so deposited falls through the storage section 35 and comes to rest with its rim 43 against the blocking member 51 and with its nose 45 resting on the upper end of the shoulder 39. Cartridges 33 which are thereafter deposited are supported in side-by-side relationship by the next lower cartridge in the stack as shown in FIG. 2.

The storage section 35 and the orienting section 37 may be contiguous, overlapping or spaced from each other by an intermediate region of the chamber 15, and this can be controlled, for example, by the location of the blocking member 51. Thus, if the blocking member 51 extended horizontally across the chamber 15 at the upper end of the shoulder 39, the sections 35 and 37 would be contiguous. In the illustrated embodiment, the blocking member 51 extends across the chamber 15 below the upper end of the shoulder 39, and accordingly, at least the lowermost cartridge 33 in the position of FIG. 2 may be considered as being within both the storage section 35 and the orienting section 37 in that the rotation of this cartridge about its nose 45 as a result of the shoulder 39 may be considered as having just begun. Also, by placing the blocking member 51 well above the upper end of the shoulder 39, there would be a region of the chamber 15 separating the storage section 35 where the cartridges 33 are normally held and the orienting section 37 which rotates the cartridges. In any event, the normal gravity flow of the cartridges 33 will be from the storage section 35 through the orienting section 37 and out through the discharge opening 17. Also, the orienting section 37 may generally be considered as being between the storage section 35 and the discharge opening 17, regardless of whether these sections are contiguous, overlapping or spaced apart.

Figure 1:
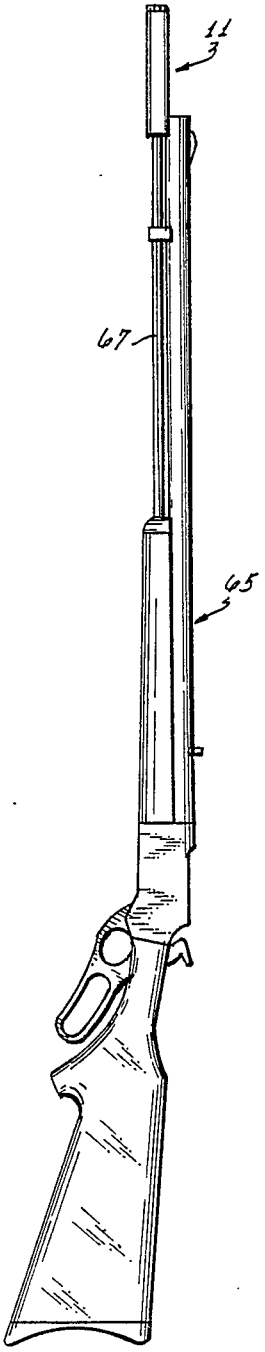
FIG. 1 shows a speed-loading device constructed in accordance with the teachings of this invention being used to load a rifle having a tubular magazine.

The speed-loading device 11 is adapted for use with a rifle 65 (FIG. 1) of conventional construction which has a conventional tubular magazine 67. To load the rifle 65, the distal end of the tubular magazine is opened, and the distal end of the magazine is placed into or against the discharge opening 17 as shown in FIG. 3. Next, the blocking member 51 is withdrawn by pulling outwardly on the tab 57. When this occurs, the stack of cartridges 33 in side-by-side relationship loses its support, and the lowermost cartridge pivots counterclockwise on the shoulder 39 about its nose 45, and the base 44 moves downwardly as permitted by the mouth 49, i.e., as permitted by the effective absence of the grooves 47. Consequently, with the container 13 oriented with the discharge opening 17 facing downwardly, the cartridges 33 fall by gravity from the storage section 35 through the orienting section 37 and out the discharge opening 17. The shoulder 39 and the discontinuance of the grooves 47 constitute orienting means for rotating the cartridges as they fall through the orienting section 37 toward the discharge opening 17. With this bit of rotation, the cartridges 33 fall base 44 first through the discharge opening 17 into the tubular magazine 67. Following use of the speed-loading device 11, the blocking member 51 can be reinserted in the bore 59, the cover 21 opened and the storage section 35 reloaded with cartridges 33. Thus, the speed-loading device 11 is adapted for repeated use.

Figure 5:
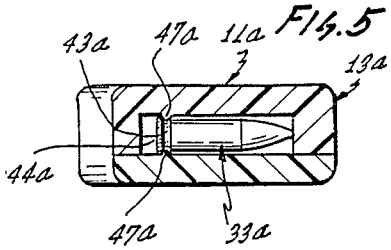
FIG. 5 is a sectional view similar to FIG. 4 showing alternate means for guiding the cartridge.

FIG. 5 shows a speed-loading device 11*a* which is identical to the speed-loading device 11 in all respects, except that it is adapted for use with rimless cartridges 33*a*. Portions of the speed-loading device 11*a* corresponding to portions of the speed-loading device 11 are designated by corresponding reference numerals followed by the letter "a." The rimless cartridges 33*a* have a groove 43*a* adjacent the base 44*a* in lieu of a rim. Accordingly, the container 13*a* has opposed ribs 47*a* for cooperation with the grooves 43*a* in lieu of the grooves shown in FIG. 4. The ribs 47*a* terminate at the same location as the grooves 47 and cooperate with the grooves 43*a* in the same manner as described above for the rim 43 and the grooves 47. The speed-loading device 11*a* can be used in the same manner as described above for the speed-loading device 11.

FIG. 7 shows a speed-loading device 11*b* which is identical to the speed-loading device 11 in all respects not shown or described herein. Portions of the speed-loading device 11*b* corresponding to portions of the speed-loading device 11 are designated by corresponding reference numerals followed by the letter "b."

The primary difference between the speed-loading devices 11 and 11*b* is that the latter is disposable rather than reusable. To this end, the container 13*b* is formed of thin, transparent plastic sheet material, and the sections thereof are permanently joined together as by a heat seal (not shown). The blocking member 51*b* has a frangible section 69 received within a wall of the container 13*b* and a ring tab 57*b*. Pulling outwardly on the ring tab 57*b* breaks the frangible section 69 to allow the cartridges 33*b* to fall by gravity through the storage section 35*b* and the orienting section 37*b* and out the discharge opening 17*b* as described above in connection with the speed-loading device 11.

The speed-loading device 11*b* is sold with the cartridges 33*b* packaged therein, and it is discarded after use. For example, the container 13*b* may be vacuum formed in multiple sections or in one open section, and the cartridges 33*b* can then be loaded into the open container. Then the container can be heat sealed closed. Of course, the speed-loading device 11*b* has no loading opening, and its upper wall 71 is integral with the remainder of the container 13*b*.

Although exemplary embodiments of the invention have been shown and described, many changes, modifications and substitutions may be made by one having ordinary skill in the art without necessarily departing from the spirit and scope of this invention.

We claim:

1. A speed-loading device for cartridges comprising:

a container having an interior chamber and a discharge opening leading from the chamber to the exterior of the container;

said container having a storage section in said chamber for storing a plurality of cartridges in side-by-side relationship within the chamber and an orienting section in the chamber between the storage section and the discharge opening;

said container being orientable so that the cartridges in the chamber can fall by gravity from the storage section through the orienting section and out through said discharge opening;

means for blocking the flow of cartridges from the chamber out through said discharge opening, said blocking means being operable to allow all of the cartridges in the chamber to rapidly fall by gravity from the chamber out through the discharge opening;

said orienting section including orienting means for rotating the cartridges as they fall through the orienting section toward said discharge opening so that the cartridges fall sequentially end first through the discharge opening; and each of the cartridges including a casing and a nose and said orienting means including a shoulder for engaging the noses of the cartridges to retard falling movement thereof and means for allowing falling movement of the casings of the cartridges to continue whereby the cartridges are rotated.

2. A device as defined in claim 1 including guide means for guiding the cartridges into the orienting section in a predetermined orientation.

3. A device as defined in claim 2 wherein said guide means includes a groove extending generally longitudinally through a length of the storage section.

4. A device as defined in claim 2 wherein the storage section has a wall which is adapted to confront the base of the cartridges and the guide means spaces the base of the cartridges from such wall.

5. A device as defined in claim 1 wherein the orienting means includes a restriction in orienting section.

6. A device as defined in claim 1 wherein said shoulder is convexly curved.

7. A device as defined in claim 1 wherein said blocking means includes a blocking member extending at least part way across the chamber, and means for releasably retaining the blocking member at least part way across the chamber.

8. A device as defined in claim 1 wherein said container has a loading opening leading to the storage section and means for releasably closing said loading opening.

9. A device as defined in claim 6 including guide means for guiding the cartridges into the orienting section in a predetermined orientation and said chamber narrows in said orienting section.

10. A device as defined in claim 1 wherein said interior chamber is elongated and the discharge opening is at one end of the container.

11. A device as defined in claim 1 wherein the storage section retains the cartridges in at least one vertically arranged row when the container is oriented so that the cartridges can fall by gravity from the storage section.

12. A device as defined in claim 1 wherein the storage section is elongated and retains the cartridges in an elongated row.

13. A device as defined in claim 1 wherein said chamber is elongated and said orienting section is shorter in the direction of elongation than said storage section.

14. A speed-loading device comprising:

a container having an interior chamber and a discharge opening leading from the chamber to the exterior of the container;

said container having a storage section in said chamber and an orienting section in the chamber between the storage section and the discharge opening;

a plurality of cartridges stored in side-by-side relationship within the storage section, said container being orientable so that the cartridges in the chamber can fall by gravity from the storage section through the orienting section and out through said discharge opening;

means for blocking the flow of the cartridges from the chamber out through said discharge opening, said blocking means being openable to allow all of the cartridges in the storage section to rapidly fall by gravity through the orienting section and through the discharge opening;

orienting means for rotating the cartridges as they fall through the orienting section toward said discharge opening so that the cartridges fall sequentially end first through the discharge opening; and each of the cartridges including a casing and a nose and said orienting means including a shoulder for engaging the noses of the cartridges to retard falling movement thereof and means for allowing falling movement of the casings of the cartridges to continue where by the cartridges are rotated.

15. A device as defined in claim 14 wherein each of said cartridges has a base and a nose at the opposite ends thereof and said cartridges fall base first through the discharge opening.

16. A device as defined in claim 14 wherein said container is constructed of thin plastic sheet material.

17. A device as defined in claim 14 wherein said blocking means includes a blocking member extending at least part way across the chamber, at least the lowermost cartridge in the storage section being supported on said blocking member when the speed-loading device is oriented with the discharge opening facing downwardly.

18. A device as defined in claim 17 including frangible means for releasably retaining the blocking member extending across the chamber.

* * * * *